US007552839B2

(12) United States Patent
Padget

(10) Patent No.: US 7,552,839 B2
(45) Date of Patent: Jun. 30, 2009

(54) FLUID TANK WITH CLIP-IN PROVISION FOR OIL STICK TUBE

(75) Inventor: Bradley D. Padget, Richfield, MN (US)

(73) Assignee: Cummins Power Generation Inc., Minneapolis, MN (US)

( * ) Notice: Subject to any disclaimer, the term of this patent is extended or adjusted under 35 U.S.C. 154(b) by 192 days.

(21) Appl. No.: 11/520,463

(22) Filed: Sep. 13, 2006

(65) Prior Publication Data

US 2008/0061067 A1 Mar. 13, 2008

(51) Int. Cl.
*B60P 3/00* (2006.01)

(52) U.S. Cl. ..... 220/564; 73/290 V

(58) Field of Classification Search ..... 73/1.73, 73/9.3, 290 R; 290/1 A, 1 R; 165/104.32; 123/41, 198; 220/562–564
See application file for complete search history.

(56) References Cited

U.S. PATENT DOCUMENTS 4,352,342 A 10/1982 Cser et al.
4,403,466 A * 9/1983 Tillotson et al. ..... 56/16.7
4,510,893 A 4/1985 Schweiger et al.
4,515,283 A * 5/1985 Suzuki ..... 215/270
4,677,943 A 7/1987 Skinner
4,739,730 A 4/1988 Jenz et al.
5,111,776 A 5/1992 Matsushiro et al.
5,163,506 A 11/1992 Attinger et al.
5,241,926 A 9/1993 Sato et al.
5,255,636 A 10/1993 Evans
5,433,175 A 7/1995 Hughes et al.
5,563,802 A 10/1996 Plahn et al.
5,680,833 A 10/1997 Smith
6,276,312 B1 8/2001 Summan et al.
6,467,286 B2 10/2002 Hasebe et al.
6,616,059 B2 9/2003 Sabhapathy et al.
6,664,751 B1 12/2003 Gabriel et al.
6,708,653 B2 3/2004 Lefrançois et al.
6,718,916 B2 4/2004 Hewkin
7,082,905 B2 8/2006 Fukuda et al.
7,096,683 B2 8/2006 Smith
7,147,038 B2 12/2006 Taguchi

FOREIGN PATENT DOCUMENTS

JP 2004-82921 3/2004

OTHER PUBLICATIONS

Co-pending U.S. Appl. No. 11/520,464.
Co-pending U.S. Appl. No. 11/520,260.
Co-pending U.S. Appl. No. 11/520,461.
Form 892 issued in co-pending U.S. Appl. No. 11/520,464.

* cited by examiner

*Primary Examiner*—Hezron Williams
*Assistant Examiner*—Gunnar J Gissel
(74) *Attorney, Agent, or Firm*—Hamre, Schumann, Mueller & Larson

(57) ABSTRACT

A fluid fill/storage/overflow reservoir/tank suitable for use with, for example, a liquid cooled engine, includes a clip-in provision for an oil stick tube that does not require removal of the oil stick tube from an engine assembly upon removal of the fluid fill/storage/overflow reservoir/tank from the engine assembly.

17 Claims, 10 Drawing Sheets

FLUID TANK WITH CLIP-IN PROVISION FOR OIL STICK TUBE

BACKGROUND OF THE INVENTION

1. Field of the Invention

This invention relates to the field of liquid cooled engines, and more specifically to a fluid storage/overflow tank such as an engine coolant tank that stores a fluid such as an engine coolant and that employs a provision for removably coupling an oil stick tube to the fluid tank.

2. Description of the Prior Art

Liquid cooled engines are known that employ fluid fill reservoirs or tanks such, but not necessarily limited to, coolant tanks. Some of these fluid fill reservoirs/tanks are manufactured using a rotational molding process familiar to those skilled in the art. Efforts have been made to centralize the location of engine maintenance features such as, for example, the fluid fill reservoir/tank and the oil fill/dip stick tube. One such effort is depicted in FIG. 1 that shows a liquid cooled engine assembly 10 that employs such a coolant tank 12. The coolant tank 12 has an orifice 14 configured to accept insertion of an oil stick tube 16. The aforementioned rotational molding process allows for provision of an orifice that wraps completely around (i.e., 360°) the oil stick tube 16 following insertion of the oil stick tube 16. Although such fluid fill reservoirs/tanks have provided advancements in the art, these known fluid fill reservoirs/tanks are not the most advantageous in terms of manufacturing costs or in terms of engine assembly maintenance capabilities. For example, removing the fluid fill reservoir/tank for replacement also requires removal of the oil fill tube, thus also requiring disassembly of oil fill tube hose clamps. Also, rotational molding processing has limitations that limit the complexity of the tank structure during the molding process.

Accordingly, it would be both beneficial and advantageous if a fluid fill reservoir/tank could be provided having a provision for an oil stick tube that does not require removal of the oil stick tube from an engine assembly upon removal of the fluid fill reservoir/tank from the engine assembly. It would be further beneficial if the fluid fill reservoir/tank structure could be manufactured having features not available when using a rotational molding process.

SUMMARY OF THE INVENTION

A fluid fill reservoir/tank suitable for use with a liquid cooled engine includes a clip-in provision for an oil stick tube that does not require removal of the oil stick tube from an engine assembly upon removal of the fluid fill reservoir/tank from the engine assembly. The fluid fill reservoir/tank includes complex structural features not available when using a conventional rotational molding process.

According to one embodiment, the fluid fill reservoir/tank includes a fluid fill port and side wall cavity configured to receive and removably retain an oil stick tube that forcibly snaps into the side wall cavity. The fluid fill reservoir/tank may optionally include at least one fluidic outlet port and at least one fluidic inlet port to transmit and receive fluid from and to the reservoir respectively. The optional ports can be employed, for example, to circulate a coolant through a secondary cooling circuit that is extraneous to an engine assembly cooling circuit, such as that shown in FIG. 2 that depicts a hybrid power system cooling system in which the fluid fill reservoir/tank is common to both the engine assembly cooling circuit and the secondary cooling circuit.

BRIEF DESCRIPTION OF THE DRAWINGS

Other aspects, features and advantages of the present invention will be readily appreciated as the invention becomes better understood by reference to the following detailed description when considered in connection with the accompanying drawing figures wherein.

While the above-identified drawing figures set forth particular embodiments, other embodiments of the present invention are also contemplated, as noted in the discussion. In all cases, this disclosure presents illustrated embodiments of the present invention by way of representation and not limitation. Numerous other modifications and embodiments can be devised by those skilled in the art which fall within the scope and spirit of the principles of this invention.

DETAILED DESCRIPTION OF THE PREFERRED EMBODIMENTS

Figure 1:
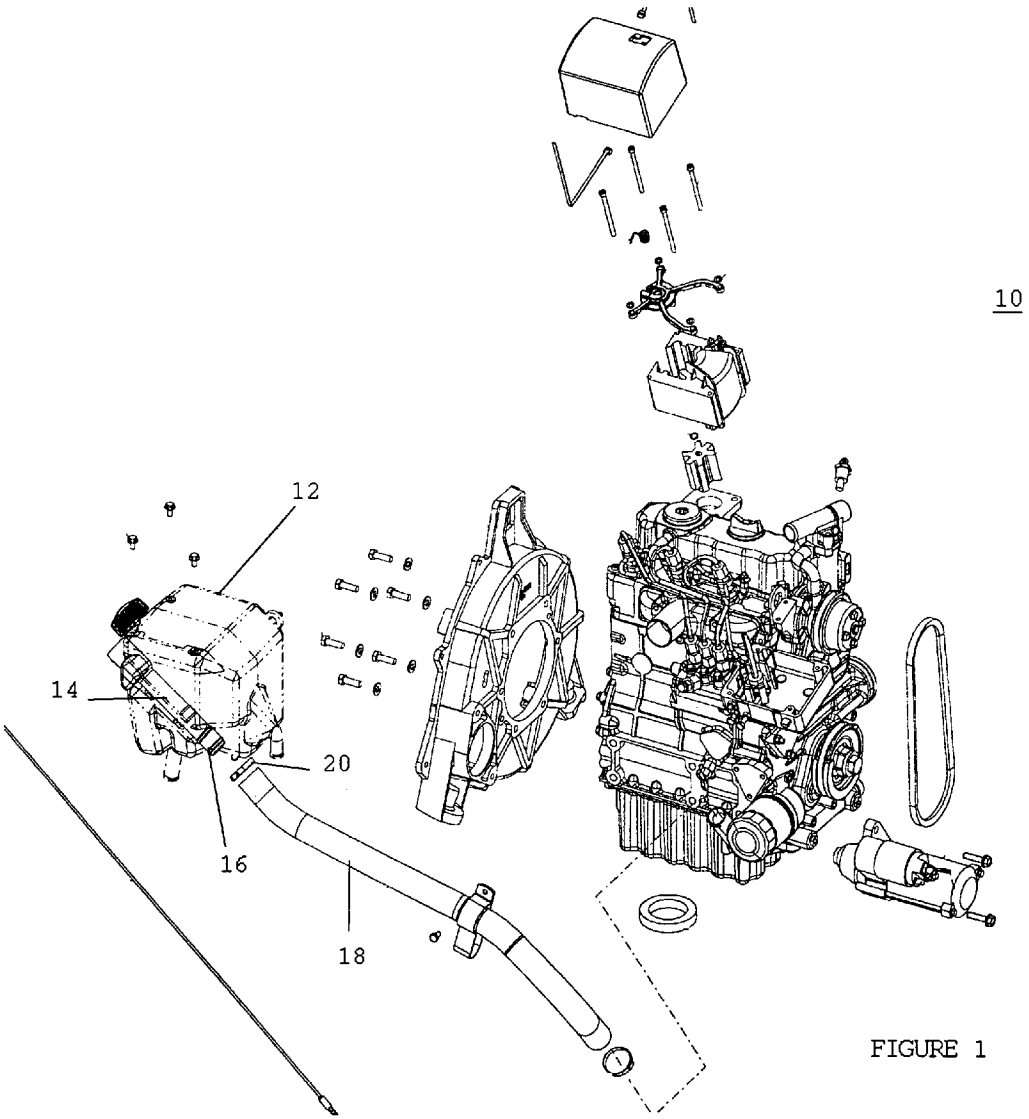
FIG. 1 is a perspective view showing a liquid cooled engine assembly including a coolant fill/overflow tank known in the art that includes an internal cavity configured to receive and completely enclose the side wall of an oil fill tube.

FIG. 1 is a perspective view showing a liquid cooled engine assembly 10 including a coolant tank 12 known in the art that includes an internal passageway 14 configured to receive and completely enclose the side wall of an oil stick tube 16. Those skilled in the molding process arts will appreciate that a rotational molding process is typically required and employed to formulate the requisite internal passageway 14 since the passageway 14 is configured to completely wrap around or encase the side wall of the oil stick tube 16. The oil stick tube 16 is coupled to an engine assembly hose 18 via at least one hose clamp 20. Removal of the coolant tank 12 also requires removal of the oil stick tube that is inserted into the passageway 14. This in turn requires dismantling the at least one hose clamp 20 in order to release the oil stick tube 16. Those skilled in the art will also appreciate that a coolant tank formulated via a rotational molding process will have limitations that prevent certain structural characteristics from being manufactured into the coolant tank. Thus, a blow molding process, although more suitable for manufacturing a more complex coolant tank such as the fluid container discussed herein below with reference to FIG. 3, does not have the capabilities of providing an internal passageway for insertion of an oil stick tube since the blow molding process is not capable of providing a passageway that completely wraps around an oil stick tube inserted into the passageway. Thus, a structure such as described herein below with reference to FIGS. 3-9 was found by the present inventor to provide very good working results when using a blow molding process to implement a fluid container such as a fluid fill reservoir/tank suitable for use with a liquid cooled engine and that includes a clip-in provision for an oil stick tube that does not require removal of the oil stick tube from an engine assembly upon removal of the fluid fill reservoir/tank from the engine assembly.

Figure 2:
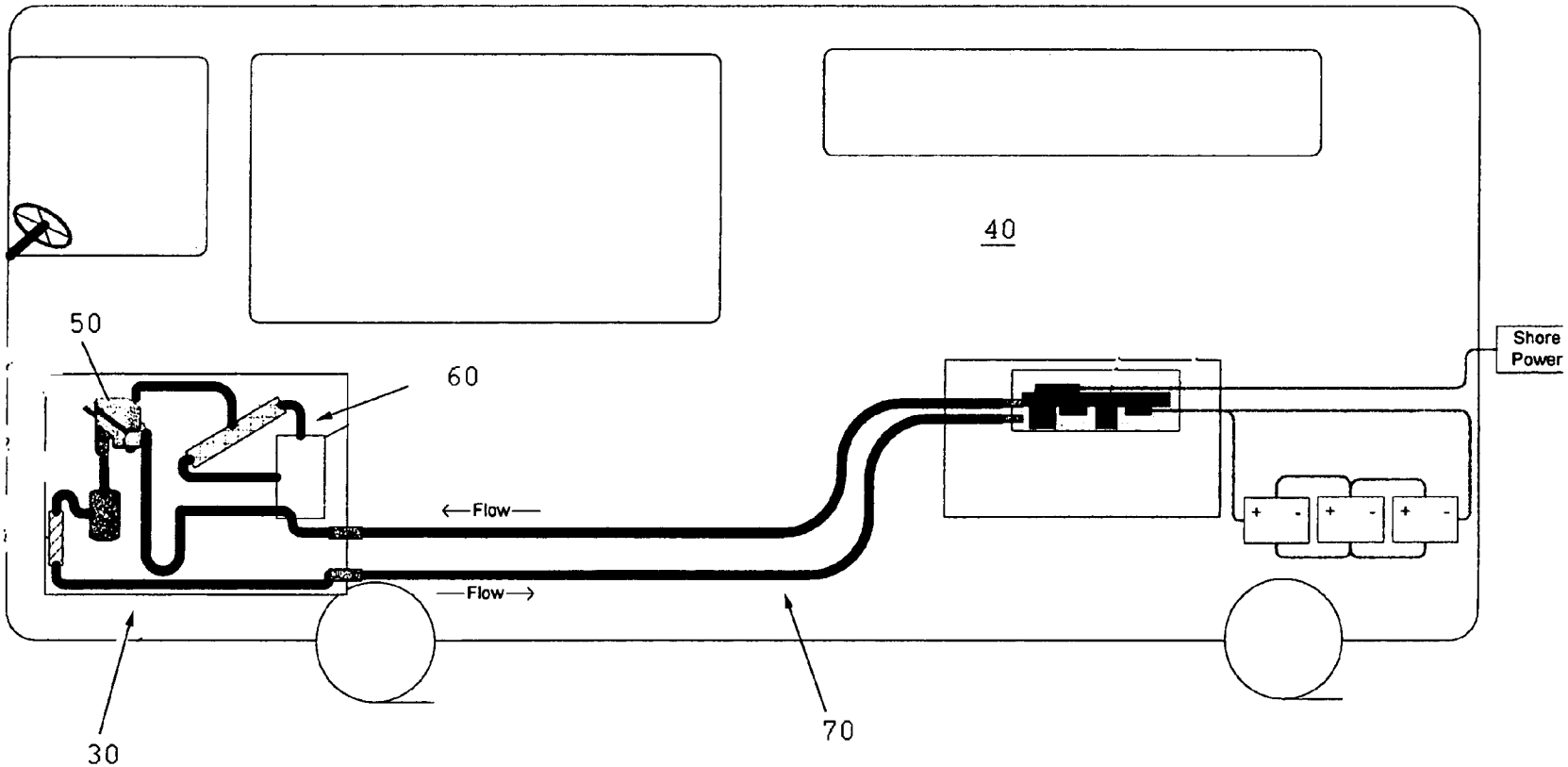
FIG. 2 is a schematic representation of a cooling system for a hybrid power system, in which the cooling system includes a liquid coolant tank that is common to both an engine cooling circuit and a secondary power system cooling circuit.

FIG. 2 is a schematic representation of a cooling system 30 for a hybrid power system onboard a recreational vehicle (RV) 40, in which the cooling system 30 includes a liquid coolant tank 50 that is common to both an engine cooling circuit 60 and a secondary power system cooling circuit 70.

A fluid reservoir/tank suitable for use with a liquid cooled engine and that includes a clip-in provision for an oil stick tube that does not require removal of the oil stick tube from an engine assembly upon removal of the fluid reservoir/tank from the engine assembly is now described herein below with reference to FIGS. 3-9. The fluid reservoir/tank has complex structural features not readily available when using a conventional rotational molding process, such as discussed herein before.

Figure 3:
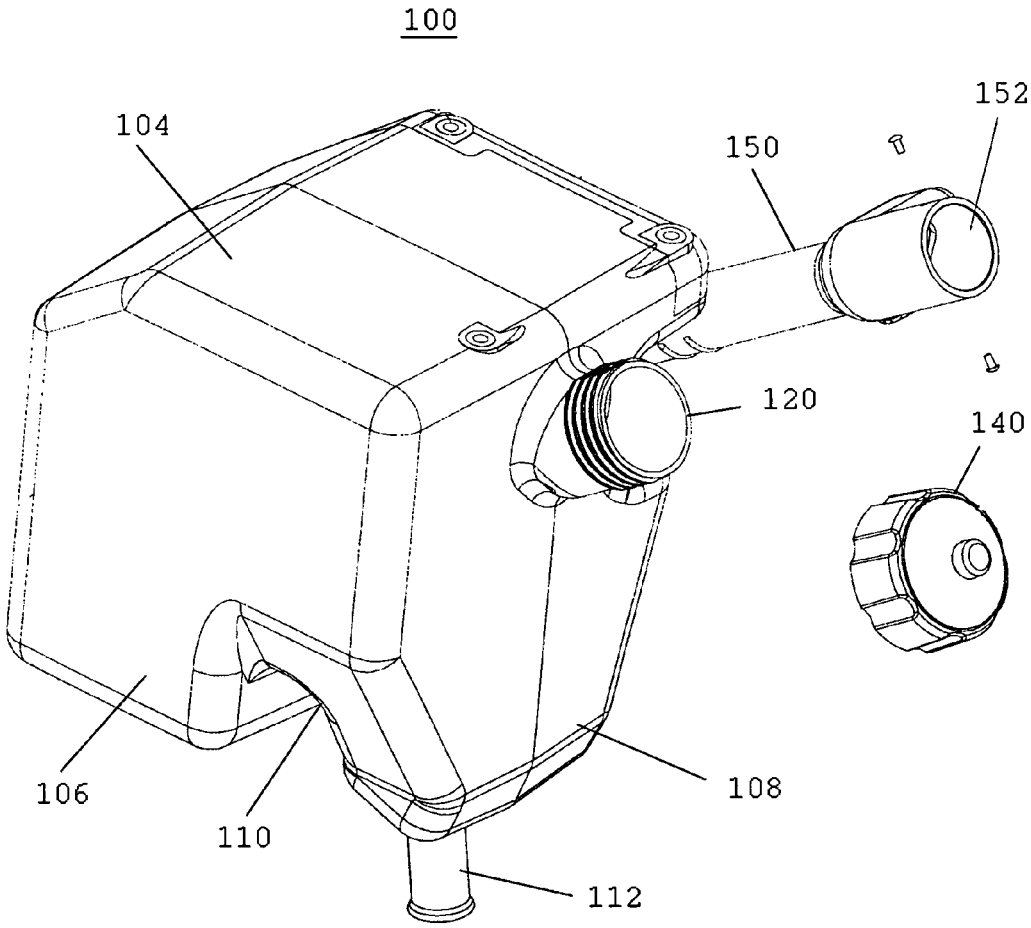
FIG. 3 is a perspective view of a fluid container according to one embodiment of the present invention.

FIG. 3 is a perspective view of a fluid (i.e., engine coolant) container 100 according to one embodiment of the present invention, and that is suitable for use as the liquid coolant tank 50 shown in FIG. 2. The present invention is not so limited however, and it shall be appreciated that fluid container 100 can be easily modified or adapted to serve, for example, as the coolant tank 12 shown in FIG. 1 or any other application that requires a liquid storage container having a structure capable of removably receiving an oil stick tube in a manner that does not also require removal of the oil stick tube during removal of the liquid storage container.

As stated herein before, coolant tank 50 is a common tank used for both an engine cooling circuit 60 and a secondary power system cooling circuit 70 as shown in FIG. 2. This configuration advantageously saves both space and money. In one embodiment, fluid tank 100 is configured as coolant tank 50 to include a blow molded polypropylene body defining an internal reservoir 102. The internal reservoir 102 is divided into an upper common volume or chamber 104 and two lower divided volumes or chambers 106 and 108, which are divided by a wall, such as dam 110. In use, coolant leaves fluid container 100 to cool the secondary power system cooling circuit 70 through outlet 112 and returns through inlet 114, shown for example, in FIG. 8. Outlet 112 is at the bottom of second chamber 108 and inlet 114 feeds coolant into first chamber 106.

Fluid tank 100 includes enough volume in the second coolant chamber 108 to allow for expansion of the volume of fluid required by the engine 130 (for example, fluid in the engine block, radiator 132, and hoses), shown for example, in FIG. 2. Thus, as the coolant expands with temperature, the excess fluid enters chamber 108 of the fluid tank 100. If more fluid comes in, it can overflow dam 110 into chamber 106 or merely fill up more of the common volume area 104. However, if any of the secondary power system cooling circuit coolant hoses leak somewhere in the cooling system 30, the engine 130 will never be without coolant because of chamber 108 and dam 110, since the amount of coolant in chamber 106 will be prevented from entering the secondary power system cooling circuit 70 though outlet 112. Fluid tank 100 optionally includes a removable cap 140 to seal the fluid tank 100 at a fill port 120.

With continued reference to FIG. 3, an oil stick tube 150 is seen removably coupled to the back side of the fluid tank 100. FIG. 10 is a side view of an oil stick tube 150 suitable for coupling to the fluid container 100 shown in FIGS. 3-9, according to one embodiment.

Figure 10:
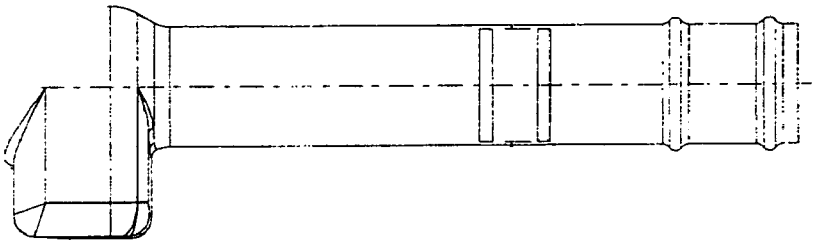
FIG. 10 is a side view of an oil fill tube suitable for coupling to the fluid container shown in FIGS. 3-9, according to one embodiment.
Figure 11:
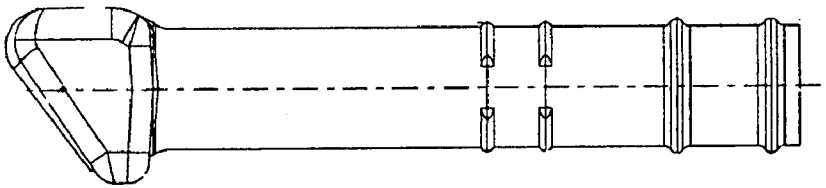
FIG. 11 is another side view of the oil fill tube shown in FIG. 10.
Figure 12:
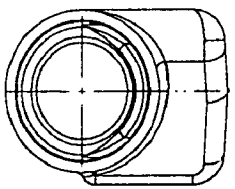
FIG. 12 is an end view of the oil fill tube shown in FIGS. 10 and 11.

FIG. 11 is another side view of the oil stick tube 150 shown in FIG. 10; and FIG. 12 is an end view of the oil stick tube 150 shown in FIGS. 10 and 11.

This feature advantageously allows the coolant fill port 120 (depicted in FIG. 3) and the oil fill port 152 (depicted in FIG. 3) to be located proximal to one another for ease of maintenance. The removable oil stick tube feature also advantageously allows the fluid container 100 to be removed and/or replaced as necessary without also requiring removal of the oil stick tube 150. The oil stick tube 150 therefore can remain securely fastened to the engine oil hose lines while the fluid container 100 is being serviced or replaced.

Figure 4:
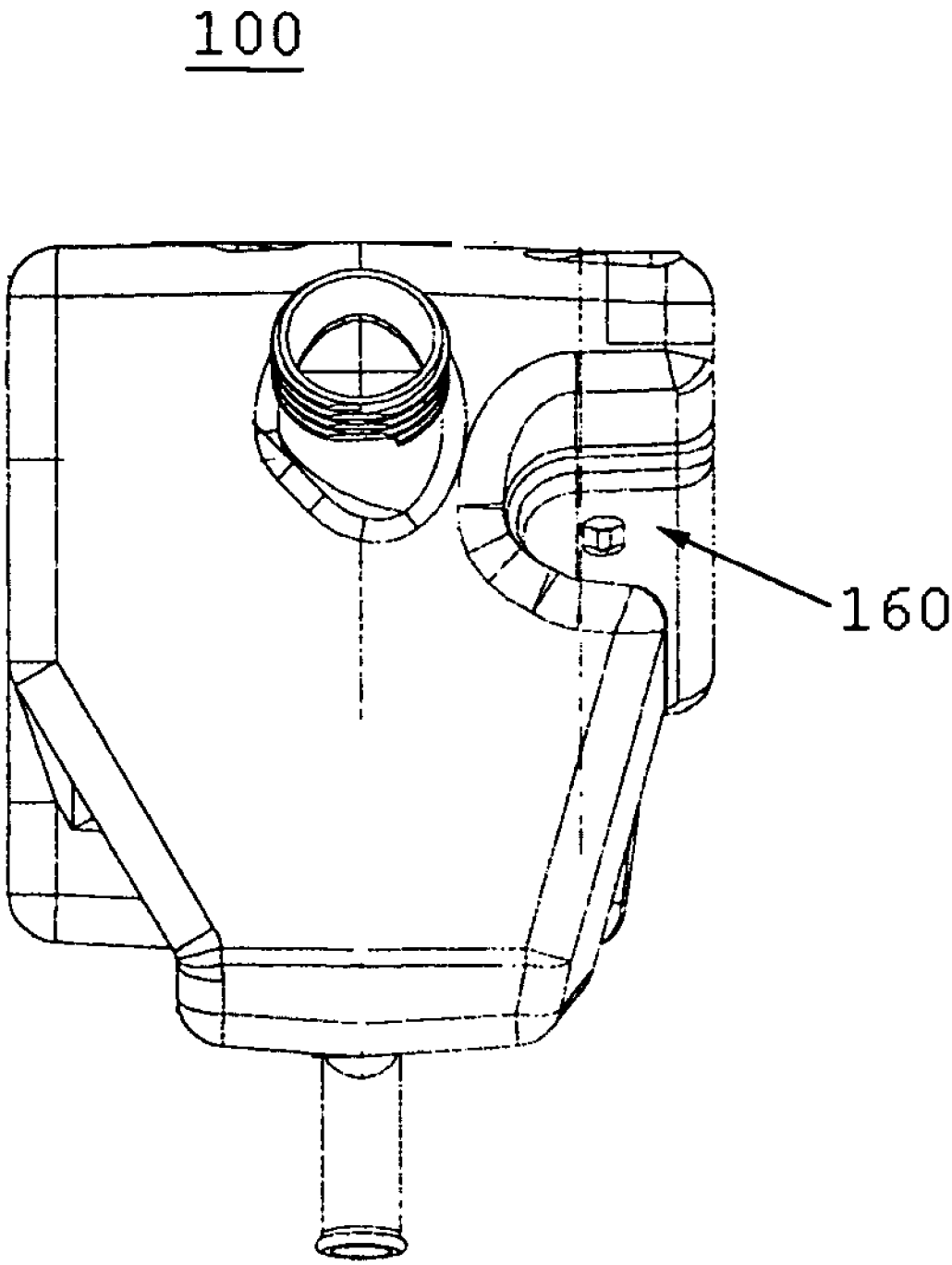
FIG. 4 is right side view of the fluid container shown in FIG. 3.

FIG. 4 is right side view of the fluid container 100 shown in FIG. 3 and can be seen to include a cavity 160 that is configured to removably receive the oil stick tube 150 shown in FIGS. 10-12, wherein FIG. 10 is a side view of an oil stick tube 150 suitable for coupling to the fluid container 100 shown in FIGS. 3-9, according to one embodiment; FIG. 11 is another side view of the oil stick tube 150 shown in FIG. 10; and FIG. 12 is an end view of the oil stick tube 150 shown in FIGS. 10 and 11. Oil stick tube 150 is most preferably constructed of the same material that is used to manufacture the fluid tank 100, i.e. polypropylene. The present invention is not so limited however, and it shall be understood that other suitable materials may optionally be employed to formulate one or both, the fluid container 100 and the oil stick tube 150.

Figure 9:
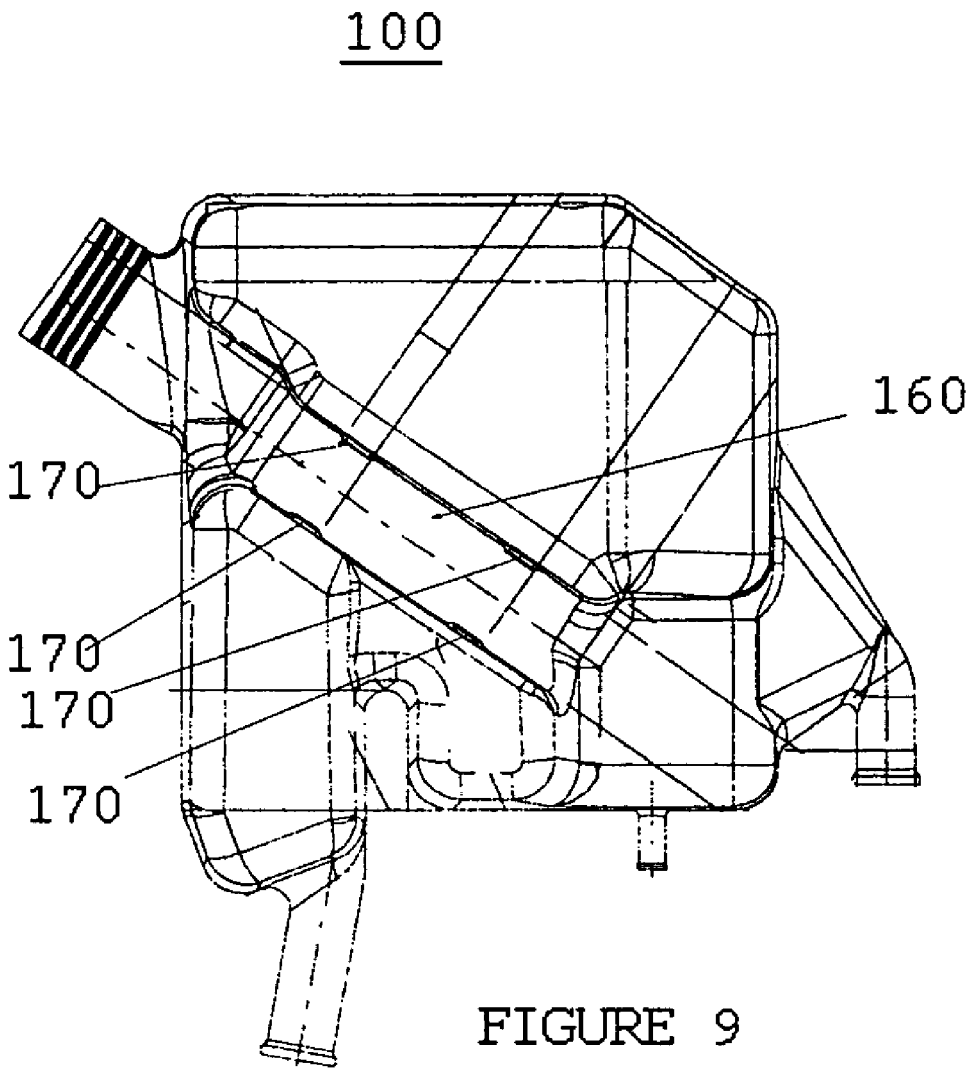
FIG. 9 is a back side view of the fluid container shown in FIG. 3.

A set of protrusions or bumps 170 within cavity 160, such as shown in FIG. 9 that is a back side view of the fluid container 100 shown in FIG. 3, provide a clip-in (snap-in) feature such that as the oil stick tube 150 is pressed into the cavity 160 from the backside of the fluid container 100, it is forcibly pressed past the set of protrusions 170 which then function to retain the oil stick tube 150 within the cavity 160.

Figure 5:
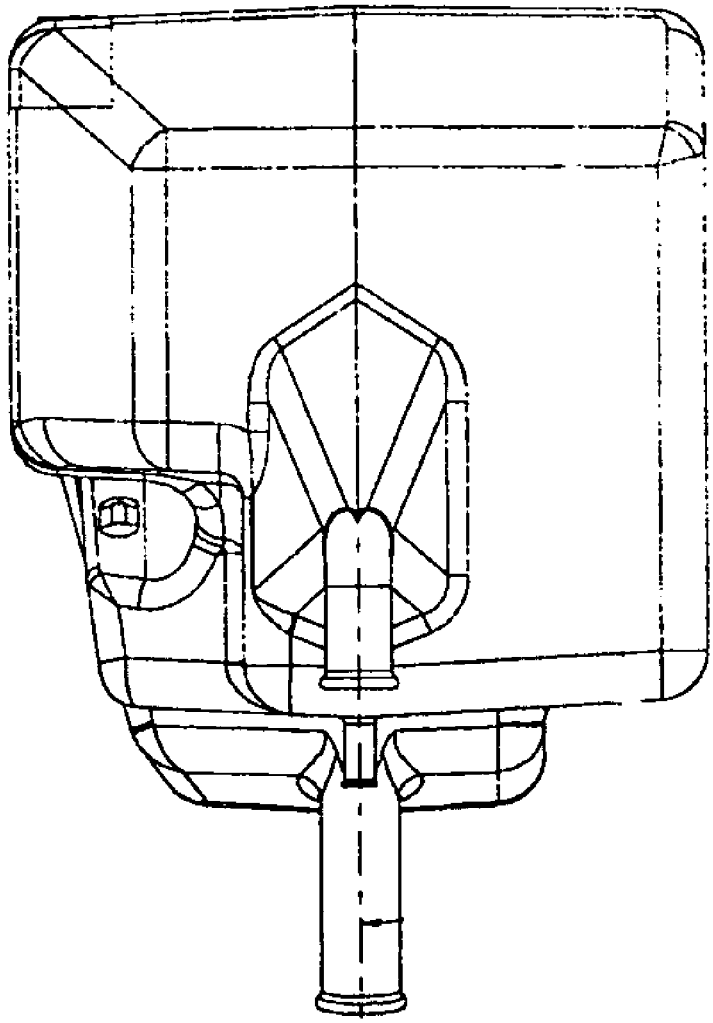
FIG. 5 is a left side view of the fluid container shown in FIG. 3.

FIG. 5 is a left side view of the fluid container 100 shown in FIG. 3.

Figure 6:
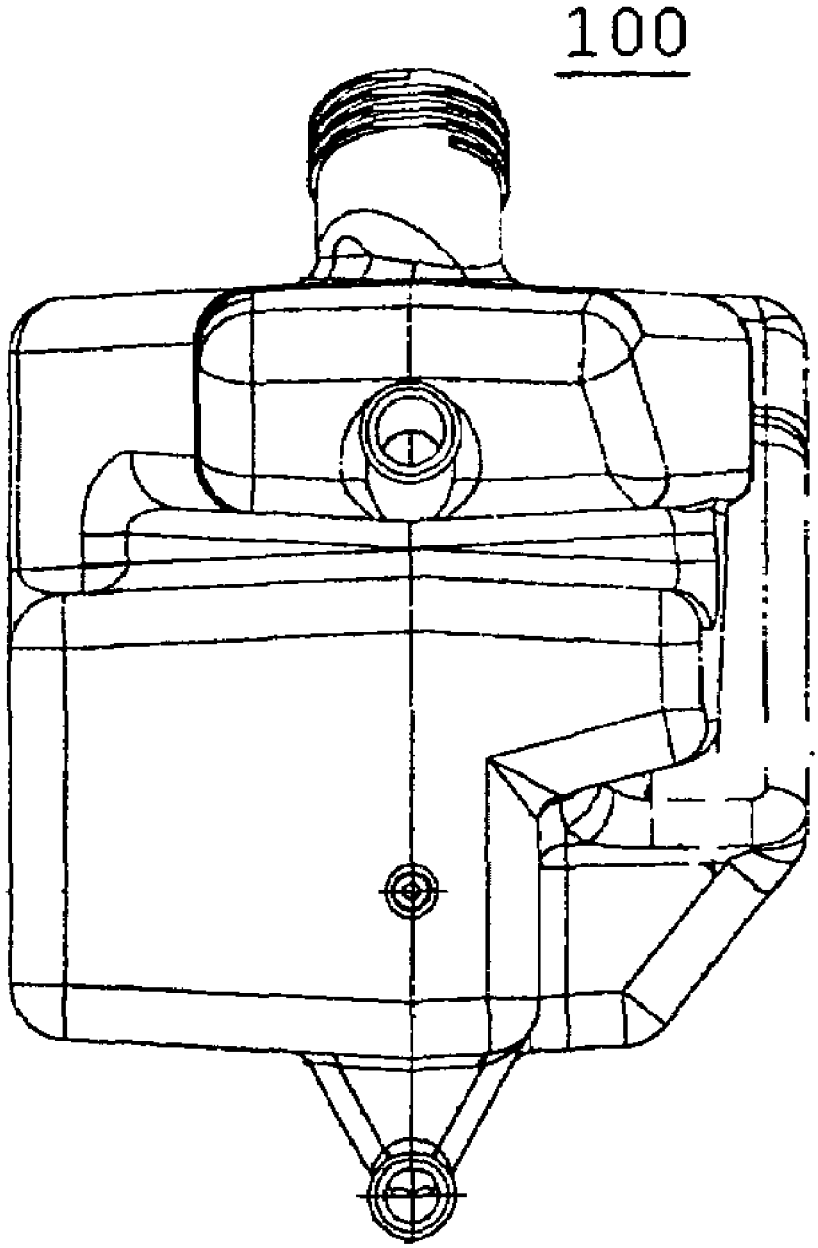
FIG. 6 is a bottom view of the fluid container shown in FIG. 3.

FIG. 6 is a bottom view of the fluid container 100 shown in FIG. 3.

Figure 7:
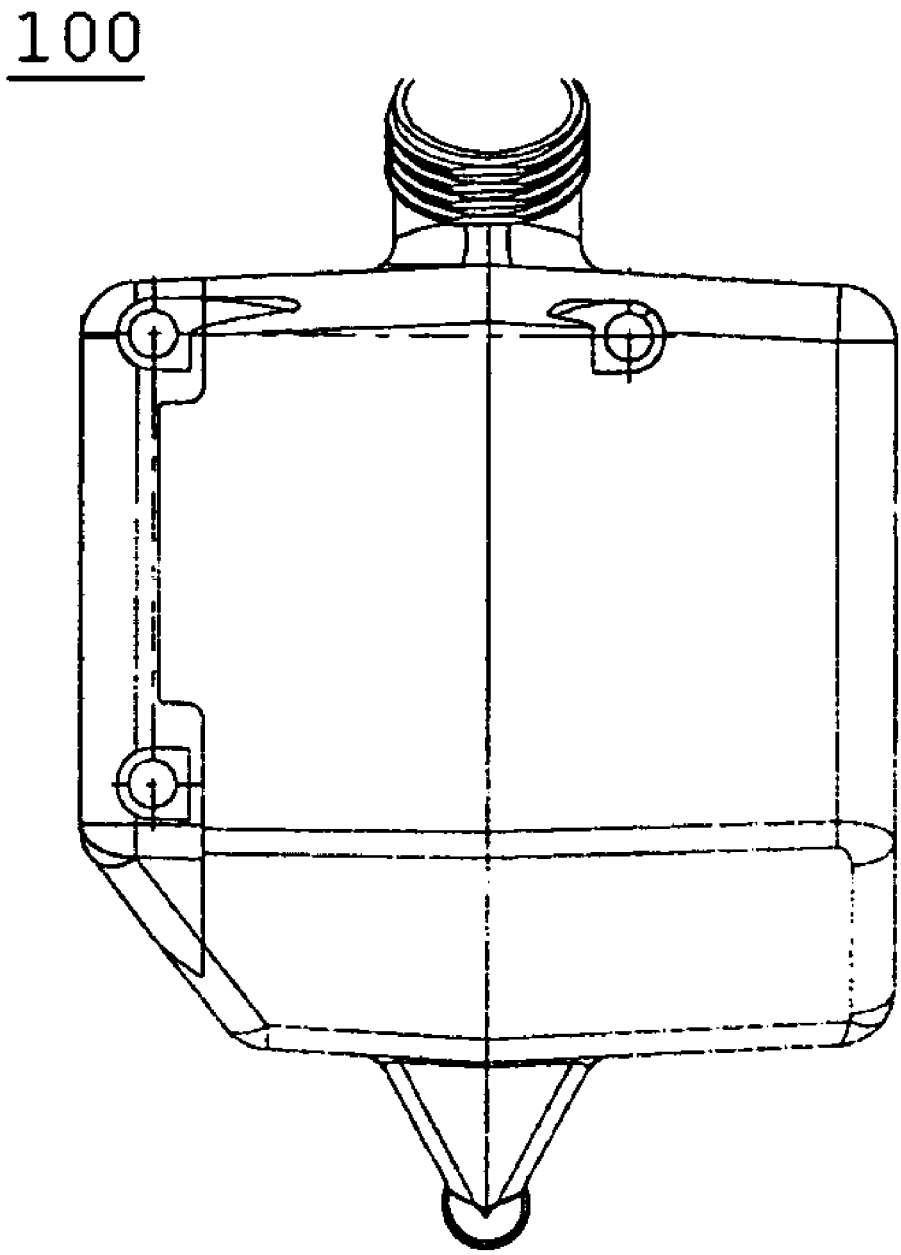
FIG. 7 is a top view of the fluid container shown in FIG. 3.

FIG. 7 is a top view of the fluid container 100 shown in FIG. 3.

Figure 8:
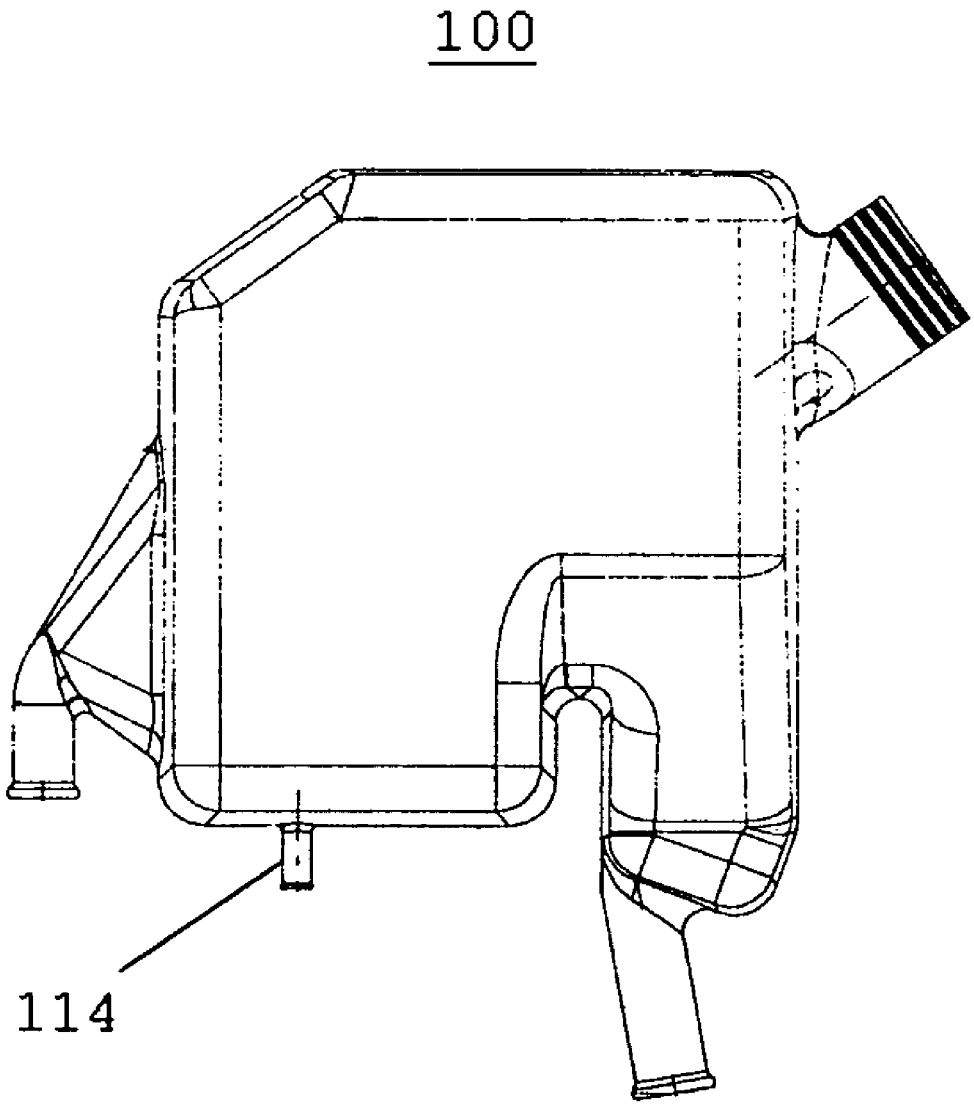
FIG. 8 is a front side view of the fluid container shown in FIG. 3.

FIG. 8 is a front side view of the fluid container 100 shown in FIG. 3.

FIG. 9 is a back side view of the fluid container 100 shown in FIG. 3.

The invention may be embodied in other forms without departing from the spirit or essential characteristics thereof. The embodiments disclosed in this application are to be considered in all respects as illustrative and not limitative. The scope of the invention is indicated by the appended claims rather than by the foregoing description; and all changes which come within the meaning and range of equivalency of the claims are intended to be embraced therein.

For example, particular embodiments have been described herein above that depict fluidic outlet and inlet ports in addition to a fluidic fill port. The present invention is not so limited, but may, for example, only include a fluidic fill port when the fluid container is applied solely to a liquid cooled engine.

What is claimed is:

1. A fluid container comprising:

a housing comprising:

a housing wall;

a fluid fill port;

at least one outlet port; and a cavity defined by an outer surface of the housing wall but not penetrating the housing wall, wherein the cavity is configured to removably receive and retain a desired oil stick tube such that when the oil stick tube is retained, the outer surface of the housing wall is in contiguous proximity with, and surrounds a majority of, an outer surface of a cross section transverse a length of the oil stick tube, without completely wrapping around the oil stick tube.

2. The fluid container according to claim 1, wherein the housing is comprised of polypropylene.

3. The fluid container according to claim 1, wherein the housing wall is translucent.

4. The fluid container according to claim 1, farther comprising a seal cap configured to seal the fluid fill port.

5. The fluid container according to claim 1, wherein the cavity comprises at least one protrusion configured such that the desired oil stick tube can only be inserted into the cavity when a predetermined force is exceeded upon pressing the desired oil stick tube into the cavity and against the at least one protrusion.

6. The fluid container according to claim 1, wherein the fluid container is an engine coolant tank.

7. A fluid container assembly comprising:

an oil stick tube; and a housing comprising:

a housing wall;

a fluid fill port;

at least one outlet port; and a cavity defined by an outer surface of the housing wall but not penetrating the housing wall, wherein the cavity is configured to removably receive and retain the oil stick tube such that when the oil stick tube is retained, the outer surface of the housing wall is in contiguous proximity with, and surrounds a majority of, an outer surface of a cross section transverse a length of the oil stick tube without completely wrapping around the oil stick tube.

8. The fluid container assembly according to claim 7, wherein the oil stick tube and the housing are comprised solely of polypropylene.

9. The fluid container assembly according to claim 7, further comprising a seal cap configured to seal the fluid fill port.

10. The fluid container assembly according to claim 7, wherein the cavity comprises at least one protrusion configured such that the oil stick tube can only be removably inserted into the cavity when a predetermined force is exceeded upon pressing the oil stick tube into the cavity and against the at least one protrusion.

11. The fluid container assembly according to claim 7, wherein the housing comprises an engine coolant tank.

12. The fluid container assembly according to claim 7, wherein the housing wall is translucent.

13. A fluid container comprising a housing adapted to removably receive an engine coolant and an engine oil stick tube, wherein the wall of the housing includes an exposed cavity that does not penetrate the wall of the housing, and further wherein the cavity is configured to removably receive and retain the oil stick tube such that when the oil stick tube is retained, the outer surface of the housing wall is in contiguous proximity with, and encloses a majority of, an outer surface of a cross section transverse a length of the oil stick tube without completely wrapping around the oil stick tube.

14. The fluid container according to claim 13, wherein fluid container is comprised solely of polypropylene.

15. The fluid container according to claim 13, further comprising a fluid fill port and a seal cap configured to seal the fluid fill port, wherein the fluid fill port and the seal cap arc comprised solely of polypropylene.

16. The fluid container according to claim 13, wherein the cavity comprises at least one protrusion configured such that the oil stick tube can only be removably inserted into the cavity when a predetermined force is exceeded upon pressing the oil stick tube into the cavity arid against the at least one protrusion.

17. The fluid container according to claim 13, wherein the wall of the housing is translucent.

* * * * *